US011964684B2

(12) United States Patent
Braband et al.

(10) Patent No.: US 11,964,684 B2
(45) Date of Patent: Apr. 23, 2024

(54) CONTROLLING A LEVEL CROSSING AND RAILWAY CONTROL ARRANGEMENT

(71) Applicant: Siemens Mobility GmbH, Bayern (DE)

(72) Inventors: Jens Braband, Braunschweig (DE); Matthias Goldammer, Munich (DE); Andreas Ziroff, Munich (DE)

(73) Assignee: SIEMENS MOBILITY GMBH, Bayern (DE)

( * ) Notice: Subject to any disclaimer, the term of this patent is extended or adjusted under 35 U.S.C. 154(b) by 820 days.

(21) Appl. No.: 17/050,400

(22) PCT Filed: Apr. 10, 2019

(86) PCT No.: PCT/EP2019/059147
§ 371 (c)(1),
(2) Date: Oct. 23, 2020

(87) PCT Pub. No.: WO2019/206641
PCT Pub. Date: Oct. 31, 2019

(65) Prior Publication Data

US 2021/0362760 A1 Nov. 25, 2021

(30) Foreign Application Priority Data

Apr. 24, 2018 (DE) ..... 10 2018 206 300.1

(51) Int. Cl.
*B61L 29/30* (2006.01)
*B61L 29/32* (2006.01)
*B61L 23/04* (2006.01)

(52) U.S. Cl.
CPC ..... *B61L 29/30* (2013.01); *B61L 29/32* (2013.01); *B61L 23/044* (2013.01)

(58) Field of Classification Search
CPC ..... B61L 29/30; B61L 29/32; B61L 23/044
See application file for complete search history.

(56) References Cited

U.S. PATENT DOCUMENTS 6,031,790 A * 2/2000 Futsuhara ..... G01H 1/12 73/636
6,292,432 B1 * 9/2001 Futsuhara ..... B61L 23/044 73/636
6,459,656 B1 * 10/2002 Futsuhara ..... G10K 11/24 73/636
2002/0027831 A1 3/2002 Futsuhara ..... 367/96

FOREIGN PATENT DOCUMENTS

WO 99 66320 12/1999 ..... G01N 29/04

OTHER PUBLICATIONS

Search Report for International Application No. PCT/EP2019/059147, 10 pages, dated Jul. 18, 2019.

* cited by examiner

*Primary Examiner* — Zachary L Kuhfuss
(74) *Attorney, Agent, or Firm* — Slayden Grubert Beard PLLC

(57) ABSTRACT

Various embodiments include a method for controlling a level crossing having barriers and signals comprising establishing a duration of a level crossing closure based at least in part on first signals caused by a first ultrasonic wave conducted in a first rail running over the level crossing and second signals caused by an ultrasonic wave conducted in a second rail running over the level crossing.

16 Claims, 1 Drawing Sheet

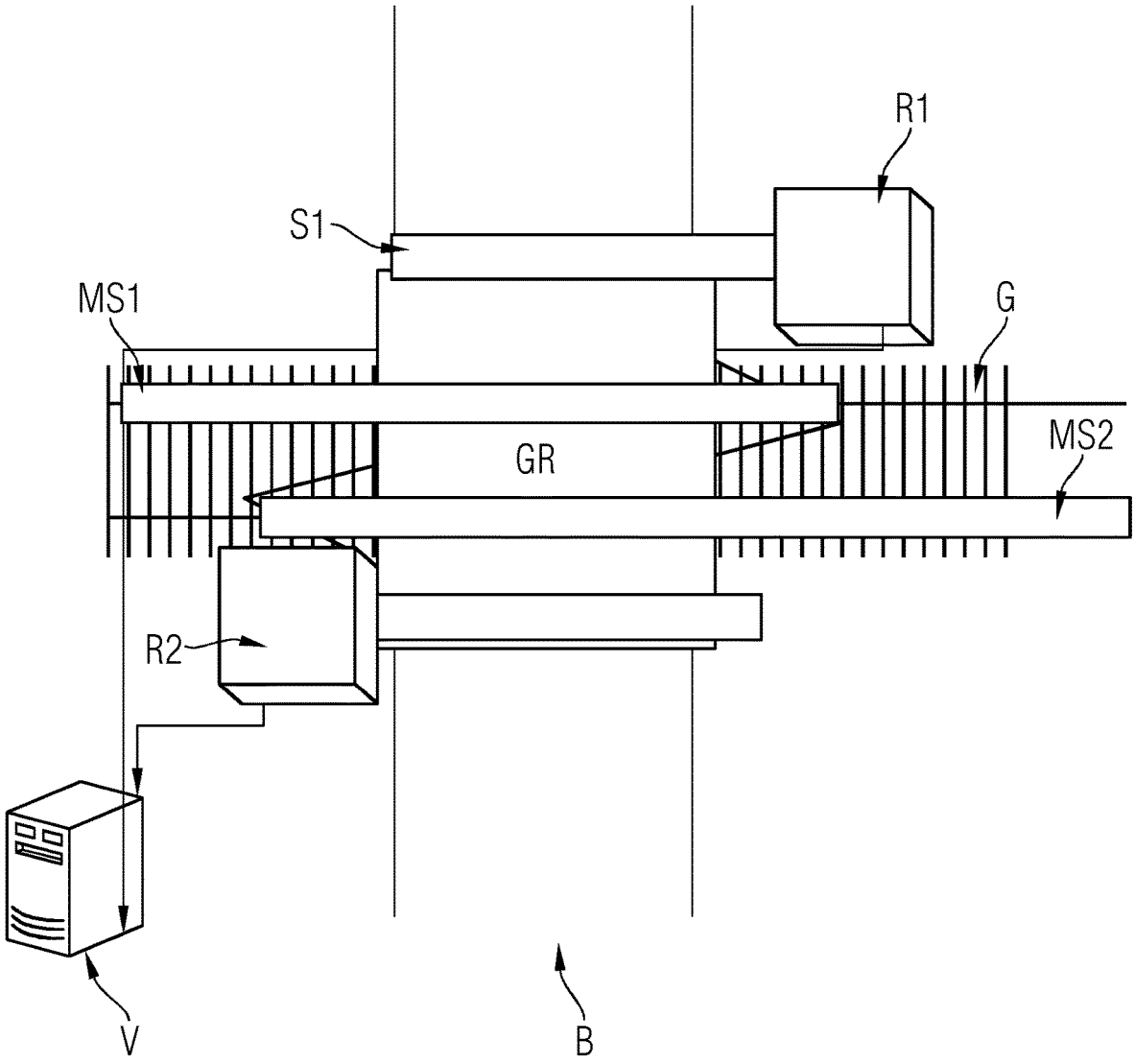
R1
S1
MS1
G
GR
MS2
R2
V
B

CONTROLLING A LEVEL CROSSING AND RAILWAY CONTROL ARRANGEMENT

CROSS-REFERENCE TO RELATED APPLICATIONS

This application is a U.S. National Stage Application of International Application No. PCT/EP2019/059147 filed Apr. 10, 2019, which designates the United States of America, and claims priority to DE Application No. 10 2018 206 300.1 filed Apr. 24, 2018, the contents of which are hereby incorporated by reference in their entirety.

TECHNICAL FIELD

The present disclosure relates to railway crossings. Various embodiments include methods for controlling a level crossing and/or railway control arrangements.

BACKGROUND

Level crossings having (full) barriers are monitored by personnel or by radar scanners. The latter is expensive, not least since in Germany they need a safety approval (SIL3). Under simple operating conditions, such as for example in telephone call barriers according to the German Railway standard DB RIL 456.0001, solutions such as time-controlled closure after a warning are also permissible. Here, however, a guarantee that the hazardous area which is substantially provided by the area between the barriers is clear when a train is passing the location is entirely lacking.

SUMMARY

The teachings of the present disclosure include solutions which overcome the disadvantages of the prior art. For example, some embodiments include a method for controlling a level crossing, in particular barriers and signals, characterized in that the time and/or duration of a level crossing closure is established on the basis of first signals which are caused by at least one first ultrasonic wave conducted in a first rail running over the level crossing, and second signals which are caused by an ultrasonic wave conducted in the second rail running over the level crossing.

In some embodiments, the signals are detected in a first time period, in which the level crossing is closed and the rails are clear, and in a second time period, in which the level crossing is open, wherein the establishment is carried out on the basis of a first comparison of the signals which are caused and detected in the first time period with the signals which are caused and detected in the second time period.

In some embodiments, the establishment is carried out on the basis of a second comparison of first and second signals which are caused.

In some embodiments, for each rail, a means for transmitting and guiding the ultrasonic wave into the rail and a means for receiving the signals which are caused is operated.

In some embodiments, the transmitting means and the receiving means are operated in a manner placed opposite each other on the edge of the road traversing the crossing.

In some embodiments, starting from an active switching of the level crossing with the barriers open, a detection of values, in particular a change in amplitude, of the signals which are caused in the second time period in the first rail and second rail is carried out cyclically.

In some embodiments, in particular when operating a telephone call barrier at the level crossing, the detection of the signals which are caused in the first time period is carried out at least temporarily, in particular in a time period following the request to open the barrier and opening the barrier.

In some embodiments, when operating a telephone call barrier at the level crossing, during the times that the barriers are closed, cyclic detection of the signals which are caused in the first time period is carried out.

In some embodiments, for the establishment and/or comparison, the amplitudes of the signals which are caused are detected.

As another example, some embodiments include a level crossing control system, characterized by means for carrying out the method or methods as described herein.

BRIEF DESCRIPTION OF THE DRAWINGS

Further details and advantages of the teachings herein are explained in more detail by using an exemplary embodiment shown in the single FIGURE showing a schematic illustration of an exemplary embodiment of the railway control arrangement carrying out a method incorporating teachings of the present disclosure.

DETAILED DESCRIPTION

Some embodiments of the teachings herein include a method for controlling a level crossing, in particular barriers and signals, the time and/or duration of a level crossing closure is established on the basis of first signals which are caused by at least one first ultrasonic wave conducted in a first rail running over the level crossing, and second signals which are caused by an ultrasonic wave conducted in the second rail running over the level crossing. As a result of causing and taking account of the first and second signals which are caused, both rails are monitored, so that a crossing vehicle which touches both rails successively with its wheels also has an influence on the at least one ultrasonic wave in the first rail and also an influence on the at least one ultrasonic wave in the second rail, which in each case has effects on the quality of the first and second signals which are caused. Thus, for example, it is possible to detect whether a motor vehicle has traversed both rails completely and thus left the hazardous area, since a contact must equally often have effects on the first and second signal which are caused. The level crossing control here can therefore react to an actual occupancy and accordingly control barriers and signals and/or influence approaching trains.

In the level crossing control arrangement according to the invention, means are provided for carrying out the methods and/or developments thereof. As a result of the arrangements described herein, implementation of the methods described herein is available, and therefore actualization of the advantages of the methods and developments thereof is made possible.

In some embodiments, the signals are detected in a first time period, in which the level crossing is closed and the rails are clear, and in a second time period, in which the level crossing is open, wherein the establishment is carried out on the basis of a first comparison of the signals which are caused and detected in the first time period with the signals which are caused and detected in the second time period. In this way, automatic standardization is achieved since, in the first time period, in which the level crossing is closed, the rails are not touched.

Thus, the qualities of the first and second signals which are caused and determined in this time period are to be assumed to be qualities which correlate with a clear hazardous space. As compared with these qualities, differing qualities of first and second signals which are caused are therefore indicators which correlate with an occupied state. This standardization according to the invention additionally has the advantage that it takes into account the local conditions, since the standardization is carried out on site by monitoring the qualities and can also be updated repeatedly and is not, for example, determined permanently and in an unadapted manner by calculated or defined standard values.

In some embodiments, the establishment is carried out on the basis of a second comparison of first and second signals which are caused, since this ability to be adapted can then have a direct influence on the control and makes the latter accurate.

In some embodiments, for each rail, a means for transmitting and guiding the ultrasonic wave into the rail and a means for receiving the signals which are caused is operated. In this way, the excitation of the rails with ultrasonic waves and the detection of signals caused thereby are provided on both rails independently of each other.

In some embodiments, the transmitting means and the receiving means are operated in a manner placed opposite each other on the edge of the road traversing the crossing. In this way, the hazardous area to be examined, in particular the rails located in the area, is covered completely.

In some embodiments, starting from an active switching of the level crossing with the barriers open, a detection of values, in particular a change in amplitude, of the signals which are caused in the second time period in the first rail and second rail is carried out cyclically, signals that are relevant to the level crossing control are detected and current data is provided only when needed, which saves energy in generation and/or detection.

In some embodiments, in particular when operating a telephone call barrier at the level crossing, the detection of the signals which are caused in the first time period is carried out at least temporarily, in particular in a time period following the request to open the barrier and opening the barrier, then the standardization can be carried out in a highly up-to-date manner, since the qualities which correlate with the clear state of the hazardous area are determined while taking into account the current environmental influences. At the same time, highly up-to-date failures of individual means that are involved can also be detected and the opening of the barrier suppressed and/or other safety processes can be triggered or processes for rectifying the failure can be initiated.

In some embodiments, for example in barriers which are not operated as telephone call barriers, or additionally, during operation of a telephone call barrier at the level crossing a cyclical detection of the signals caused in the first time period takes place while the barrier is closed. In this way, continuous updating of the standardization can be ensured. In addition, functional failures can be determined early and rectification processes initiated.

In some embodiments, for the establishment and/or comparison, the amplitudes of the signals which are caused are detected. Amplitudes correlate very well with changes on the rails and are thus very well suited as a quality of the signals which are caused which is to be monitored.

The FIGURE shows a design variant of the arrangement for controlling a level crossing which has the advantages of the methods described herein, which offers a solution which manages without any additional equipment of the trains and which nevertheless offers a reliable self-test. It is possible to see a level crossing B, which is passed by a track G, which is formed by a first rail R1 and a second rail R2.

Also indicated is a first barrier S1, which prevents the track G from being traversed from one side, and a second barrier S2, which prevents the track G being traversed from the opposite side. Thus, the access to a hazardous area GR on the tracks when a train passes the crossing B is barred.

The barriers S1 . . . S2 are closed in a general level crossing because of an approaching train when the result of an examination of the rails R1 . . . R2 permits conclusions to the effect that vehicles and/or other traffic have passed both rails.

To this end, a first measurement section MS1 is installed on the first rail S1, and a second measurement section MS2 is provided on the second rail S2. In the example illustrated, these are measurement sections which are based in terms of their configuration on the measurement sections from the area of rail breakage detection. In rail breakage detection and thus in the example shown, monitoring is as a rule carried out with guided ultrasonic waves. For this purpose, in a first step (ultra)sonic modes of typically<100 kHz are excited in the rail S1 . . . S2 via an excitation unit, for example a piezo-based oscillator, and propagate along the rail S1 . . . S2.

In a following step, these modes are detected by a sensor at a distance of several hundred meters up to several kilometers. Thus, an approaching train and its influence on the ultrasonic waves in the rails S1 . . . S2 can be detected early.

In the event of a rail breakage, the amplitude of the received signal is reduced or the signal fails completely. Other influences on the rail S1 . . . S2 likewise lead to a reduction of the signal, such as attachments to the track, cross-sectional changes or objects which are in contact with the track. A massive object such as, for example, the wheels of locomotives, likewise leads to a slight signal change, depending on mode.

In some embodiments, this system can also be used for the detection of traversing road traffic and objects. By optimizing the system, e.g. by adapting the frequencies and modes, this signal change can, however, be improved further as compared with the systems for rail breakage detection, so that the detection of (motor vehicle) wheels, pedestrians or other objects can be improved, in particular adapted thereto. The teachings of the present disclosure thus include this rail breakage detection in the manner of "axle counting" or detection of contacts in order to use this for the level crossing control.

In the exemplary embodiment, a sensor and a receiver (not illustrated) are installed for each rail R1 . . . R2, specifically at the road edge in each case, which is illustrated schematically by the delimitation of the measurement sections MS1 . . . MS2 in the FIGURE. In the general application, i.e. not level crossings having telephone call barriers, it is therefore possible to detect whether a massive object is located on the rail as during the hazardous area message. To this end, according to this exemplary embodiment, measurements are carried out cyclically during operation and a current measurement standard without any influences determined.

This standardization variable (standard) can vary depending on ambient conditions, for example humidity, temperature, soiling. When the barriers S1 . . . S2 are closed, the current measurement is compared with the current standard for the hazardous area clear message, and a warning is given in the event of significant deviation.

In this way, the teachings herein may be used to overcome the difficulty of filtering out an uninfluenced measurement, although as a rule road vehicles cross. In the specific application of the telephone call barriers, the barriers are closed as standard and are open only upon a telephone call and following clearance of possibly approaching trains. This means that no vehicles cross and, when the barriers are open, trains are also at least 1 km away.

During this time, the measuring devices MS1 . . . MS2 of the two rails R1 . . . R2 in an alternative configuration of the invention transmit and receive pulses continuously, so that each measuring device MS1 . . . MS2 can itself detect the failure on its own. As a result of the comparison of the two systems, even smaller deviations of the system can additionally likewise be established. The two systems thus monitor themselves mutually.

If the telephone call barrier is then requested, first of all both measuring devices MS1 . . . MS2 must detect "CLEAR" and can determine the measurement standard. After that, when an object, for example a car, traverses the level crossing, they should detect the same number of influences on the signals which are caused by the ultrasound, that is to say detect "OCCUPIED" equally often.

Deviations must be tolerated or detected, for example when a pedestrian steps on the rail on one side but not on the other side. Therefore, in the event of discrepancies, before the barrier S1 . . . S2 is closed, a visual and acoustic warning should be given and in this case the barriers S1 . . . S2 should be closed only with a time delay of, for example, 1 minute. If, after the barriers S1 . . . S2 have been closed, both sensors MS1 . . . MS2 have detected the hazardous area GR as "CLEAR", trains can travel over the section again. In a development, the detection of pedestrians and other objects can also be trained by machine learning, so that alternative control steps are conceivable for this purpose. The teachings herein allow the use of conventional sensors.

The scope of the present disclosure is not restricted to the exemplary embodiment illustrated and described of the arrangements and the methods. Instead, all variants defined by the claims should be covered, if they permit the core that is important for the use of conventional sensors to provide a simple failure disclosure by mutual observation and evaluation by incorporating the operating sequences at the level crossing B, and therefore offer variants for different approval and safety requirements, so that a remote-operation technology for the time-optimized safeguarding of level crossings is provided.

What is claimed is:

1. A method for controlling a level crossing having barriers and signals, the method comprising:

establishing a duration of a level crossing closure based at least in part on first signals caused by a first ultrasonic wave conducted in a first rail running over the level crossing and second signals caused by an ultrasonic wave conducted in a second rail running over the level crossing;

detecting the first signals and the second signals in a first time period, in which the level crossing is closed and the rails are clear; and detecting the first signals and the second signals in a second time period, in which the level crossing is open;

wherein establishing the duration includes a first comparison of the signals detected in the first time period to the signals detected in the second time period.

2. The method as claimed in claim 1, wherein establishing the duration includes a second comparison of the first signals and the second signals.

3. The method as claimed in claim 2, further comprising, for each rail:

transmitting and guiding an ultrasonic wave into the rail; and receiving the resulting signals.

4. The method as claimed in claim 3, wherein transmitting means and receiving means are placed opposite each other on an edge of the road traversing the crossing.

5. The method as claimed in claim 1, further comprising starting from an active switching of the level crossing with the barriers open, detecting values including a change in amplitude of the signals caused in the second time period in the first rail and second rail cyclically.

6. The method as claimed in claim 1, wherein a telephone call barrier operates at the level crossing, the detection of the signals which are caused in the first time period is carried out at least temporarily in a time period following the request to open the barrier and opening the barrier.

7. The method as claimed in claim 1, wherein a telephone call barrier operates at the level crossing; and during the times that the barriers are closed, cyclically detecting the signals caused in the first time period.

8. The method as claimed in claim 1, further comprising detecting amplitudes of each signal for the comparison.

9. A method for controlling a level crossing having barriers and signals, the method comprising:

establishing a duration of a level crossing closure based at least in part on first signals caused by a first ultrasonic wave conducted in a first rail running over the level crossing and second signals caused by an ultrasonic wave conducted in a second rail running over the level crossing;

transmitting and guiding an ultrasonic wave into the rail using a separate transmitter and a separate receiver for each rail; and receiving the resulting signals;

wherein establishing the duration includes a second comparison of the first signals and the second signals.

10. The method as claimed in claim 9, further comprising:

detecting the first signals and the second signals in a first time period, in which the level crossing is closed and the rails are clear; and detecting the first signals and the second signals in a second time period, in which the level crossing is open;

wherein establishing the duration includes a first comparison of the signals detected in the first time period to the signals detected in the second time period.

11. The method as claimed in claim 10, further comprising starting from an active switching of the level crossing with the barriers open, detecting values including a change in amplitude of the signals caused in the second time period in the first rail and second rail cyclically.

12. The method as claimed in claim 10, wherein a telephone call barrier operates at the level crossing, the detection of the signals which are caused in the first time period is carried out at least temporarily in a time period following the request to open the barrier and opening the barrier.

13. The method as claimed in claim 10, wherein a telephone call barrier operates at the level crossing; and during the times that the barriers are closed, cyclically detecting the signals caused in the first time period.

14. The method as claimed in claim 9, wherein establishing the duration includes a second comparison of the first signals and the second signals.

15. The method as claimed in claim 9, wherein transmitting means and receiving means are placed opposite each other on an edge of the road traversing the crossing.

16. The method as claimed in claim 9, further comprising detecting amplitudes of each signal for the comparison.

* * * * *